US007775190B2

(12) United States Patent
Vu

(10) Patent No.: US 7,775,190 B2
(45) Date of Patent: Aug. 17, 2010

(54) RADIAL PISTON PUMP FOR SUPPLYING FUEL AT HIGH PRESSURE TO AN INTERNAL COMBUSTION ENGINE

(75) Inventor: Ngoc-Tam Vu, Ludwigsburg (DE)

(73) Assignee: Continental Automotive GmbH, Hannover (DE)

( * ) Notice: Subject to any disclaimer, the term of this patent is extended or adjusted under 35 U.S.C. 154(b) by 79 days.

(21) Appl. No.: 12/296,773

(22) PCT Filed: Apr. 10, 2007

(86) PCT No.: PCT/EP2007/053455

§ 371 (c)(1),
(2), (4) Date: Nov. 19, 2008

(87) PCT Pub. No.: WO2007/116053

PCT Pub. Date: Oct. 18, 2007

(65) Prior Publication Data

US 2009/0126695 A1 May 21, 2009

(30) Foreign Application Priority Data

Apr. 11, 2006 (DE) ..... 10 2006 017 037

(51) Int. Cl.
*F04B 1/04* (2006.01)
*F04B 39/10* (2006.01)

(52) U.S. Cl. ..... 123/446; 417/273; 417/470; 417/295

(58) Field of Classification Search ..... 123/445, 123/446, 447, 495; 417/273, 295, 470, 454
See application file for complete search history.

(56) References Cited

U.S. PATENT DOCUMENTS

| | | | | |
|---|---|---|---|---|
| 5,213,482 | A * | 5/1993 | Reinartz et al. | 417/273 |
| 5,249,935 | A * | 10/1993 | Burgdorf | 417/415 |
| 5,277,553 | A * | 1/1994 | Stolpp | 417/273 |
| 6,176,692 | B1 * | 1/2001 | Reinartz et al. | 417/454 |
| 6,224,350 | B1 * | 5/2001 | Guentert et al. | 417/273 |
| 6,224,351 | B1 * | 5/2001 | Simon et al. | 417/273 |
| 6,334,762 | B1 * | 1/2002 | Hauser et al. | 417/569 |
| 6,457,957 | B1 | 10/2002 | Bauer et al. | |
| 7,118,350 | B2 | 10/2006 | Graf et al. | |

(Continued)

FOREIGN PATENT DOCUMENTS

DE 197 29 791 A1 1/1999

(Continued)

*Primary Examiner*—Thomas N Moulis
(74) *Attorney, Agent, or Firm*—King & Spalding L.L.P.

(57) ABSTRACT

A radial piston pump for supplying fuel at high-pressure to an internal combustion engine has a compression chamber arranged in a displacement housing, a reciprocating piston arranged in a cylinder chamber, a suction valve connected to a fuel supply line and has a spring-loaded closure body, an intermediate piece, a threaded pin and a pressure valve which is connected to a fuel outlet line. The closing body of the suction valve is embodied as a valve end pad with the spring exerting a force on the front end thereof. The valve end pad has a closure collar and at least two channels that are distributed around the periphery and which adjoin the closure collar and a base plate. A stop plate comprising an additional base plate borders the closure collar of the valve end pad as an intermediate piece to which the threaded pin is connected.

18 Claims, 2 Drawing Sheets

U.S. PATENT DOCUMENTS

| | | | | |
|---|---|---|---|---|
| 2004/0035396 | A1 * | 2/2004 | Braun et al. | 123/447 |
| 2005/0100448 | A1 | 5/2005 | Graf et al. | |
| 2007/0095405 | A1 | 5/2007 | Nigrin et al. | |

FOREIGN PATENT DOCUMENTS

| | | | |
|---|---|---|---|
| DE | 19729791 | A1 | 1/1999 |
| DE | 198 48 035 | A1 | 4/2000 |
| DE | 19848035 | A1 | 4/2000 |
| DE | 19841642 | C2 | 7/2002 |
| DE | 101 17 600 | C1 | 8/2002 |
| DE | 10117600 | C1 | 8/2002 |
| DE | 102 28 552 | B4 | 1/2004 |
| DE | 10 2004 028073 | B3 | 8/2005 |
| DE | 102004028073 | B3 | 8/2005 |
| DE | 10228552 | B4 | 2/2006 |
| WO | WO 03/038270 | A1 | 5/2003 |
| WO | WO 03038270 | A1 | 5/2003 |
| WO | WO 2004/003385 | A | 1/2004 |
| WO | WO 2004003385 | A1 | 1/2004 |
| WO | WO 2005/078273 | A | 8/2005 |
| WO | WO 2005078273 | A1 | 8/2005 |

* cited by examiner

RADIAL PISTON PUMP FOR SUPPLYING FUEL AT HIGH PRESSURE TO AN INTERNAL COMBUSTION ENGINE

CROSS-REFERENCE TO RELATED APPLICATIONS

This application is a U.S. National Stage Application of International Application No. PCT/EP2007/053455 filed Apr. 10, 2007, which designates the United States of America, and claims priority to German Application No. 10 2006 017 037.7 filed Apr. 11, 2006, the contents of which are hereby incorporated by reference in their entirety.

TECHNICAL FIELD

The invention relates to a radial piston pump for supplying fuel at high pressure to an internal combustion engine, comprising a compression chamber arranged in a displacement housing, a reciprocating piston arranged in a cylinder chamber, a suction valve which is connected to a fuel supply line and comprises a spring-loaded closure body, an intermediate piece and a threaded pin and with a pressure valve which is connected to a fuel outlet line.

BACKGROUND

A radial piston pump unit is already known as the prior art, in which the suction valve is arranged transverse to the vertical axis of the reciprocating piston (DE 102 28 552 B4). The function of this suction valve is to open within a very short time to promote the maximum flow then to close again reliably. In addition the suction valve should be wear-resistant and keep its shape for 1,800 bar with an optimum clearance volume.

These aforementioned parameters can only be fulfilled in the known prior art at high cost and with high constructional outlay.

SUMMARY

A suction valve can be designed so that it is streamlined, wear-resistant and keeps its shape with optimization of the clearance volume.

According to an embodiment, a radial piston pump for supplying fuel at high pressure to an internal combustion engine, may comprise a compression chamber arranged in a displacement housing, a reciprocating piston arranged in a cylinder chamber, a suction valve connected to a fuel supply line with a spring loaded closure body, an intermediate piece and a threaded pin; and a pressure valve connected to a fuel outlet line, wherein the closure body of the suction valve is embodied as a valve end pad to the face side of which the spring is applied with a closure collar and adjoining said collar with at least two channels distributed around its periphery and with a base plate and wherein a stop plate with an additional base plate borders the closure collar of the valve end pad as an intermediate piece, to which the threaded pin is connected.

According to a further embodiment, the valve end pad may have three channels distributed around its periphery which pass through the base plate. According to a further embodiment, the stop plate, on its side facing away from the closure collar may have at least two channels running radially connected to the base plate which lie in the area of the fuel supply line. According to a further embodiment, the suction valve can be arranged in the transverse direction to a vertical axis of the piston. According to a further embodiment, the suction valve can be arranged in the displacement housing. According to a further embodiment, the valve end pad can be supported displaceably in a cylinder chamber of the displacement housing and defines with its front side facing towards the spring and the front side of the cylinder chamber the stroke of the suction valve. According to a further embodiment, the threaded pin may have a collar which with its face side adjoins the zone of the stop plate in which the base plate and the two channels are arranged. According to a further embodiment, the threaded pin bordering the area of the threads may have a groove around its circumference, into which an annular seal is inserted. According to a further embodiment, the stop plate can be arranged between a collar in the displacement housing and the threaded pin, which is adjoined by the smaller-diameter cylinder chamber for the valve end pad.

BRIEF DESCRIPTION OF THE DRAWINGS

The invention is explained in greater detail below with reference to an exemplary embodiment shown in the drawing. The drawing shows the following.

DETAILED DESCRIPTION

In accordance with various embodiments, the closure body of the suction valve is embodied as a valve end pad, to the front side of which the spring is applied with a closure collar and with adjoining it at least two channels distributed around the periphery and being embodied with a base plate and with a stop plate with a further through-opening to which the threaded pin is connected bordering the closure collar of the valve end stop.

This produces the advantage of the valve end pad embodied as a flat seat design with cutouts being well guided centrally in the displacement unit. The valve lift is simplified by the gap between the valve end pad and displacement unit, so that lift adjustment is no longer required. A cost-effective construction is produced since the valve can be made from ceramics or from sintered material for example.

In a further embodiment the valve end pad can have three channels distributed over the periphery which pass through the base plate. In this case the stop plate, on its side facing away from the closure collar, can have at least two channels running radially, connected to the through-opening, which lie in the area of the fuel supply line. The suction valve, as in the known prior art, can be arranged transverse to the vertical axis of the piston and in the displacement housing.

In a further embodiment the valve pad end can be supported displacably in a cylinder chamber of the displacement housing and, with its front side facing towards the spring and the front side of the cylinder chamber, can define the stroke of the suction valve.

Constructionally there is also the option of the threaded pin bordering with a collar on the zone of the stop plate in which the base plate and the two channels are arranged. In this case the threaded pin can have a groove running around it adjoining the area of the threads, into which an annular seal is inserted. This thus results in increased safety during continuous pump operation, since a high pre-tension force through threaded pin with a good seal is achieved.

In a further embodiment the stop plate can be arranged between a collar in the displacement housing and the threaded pin, which is adjoined by the smaller diameter cylinder chamber for the valve end pad.

Figure 1:
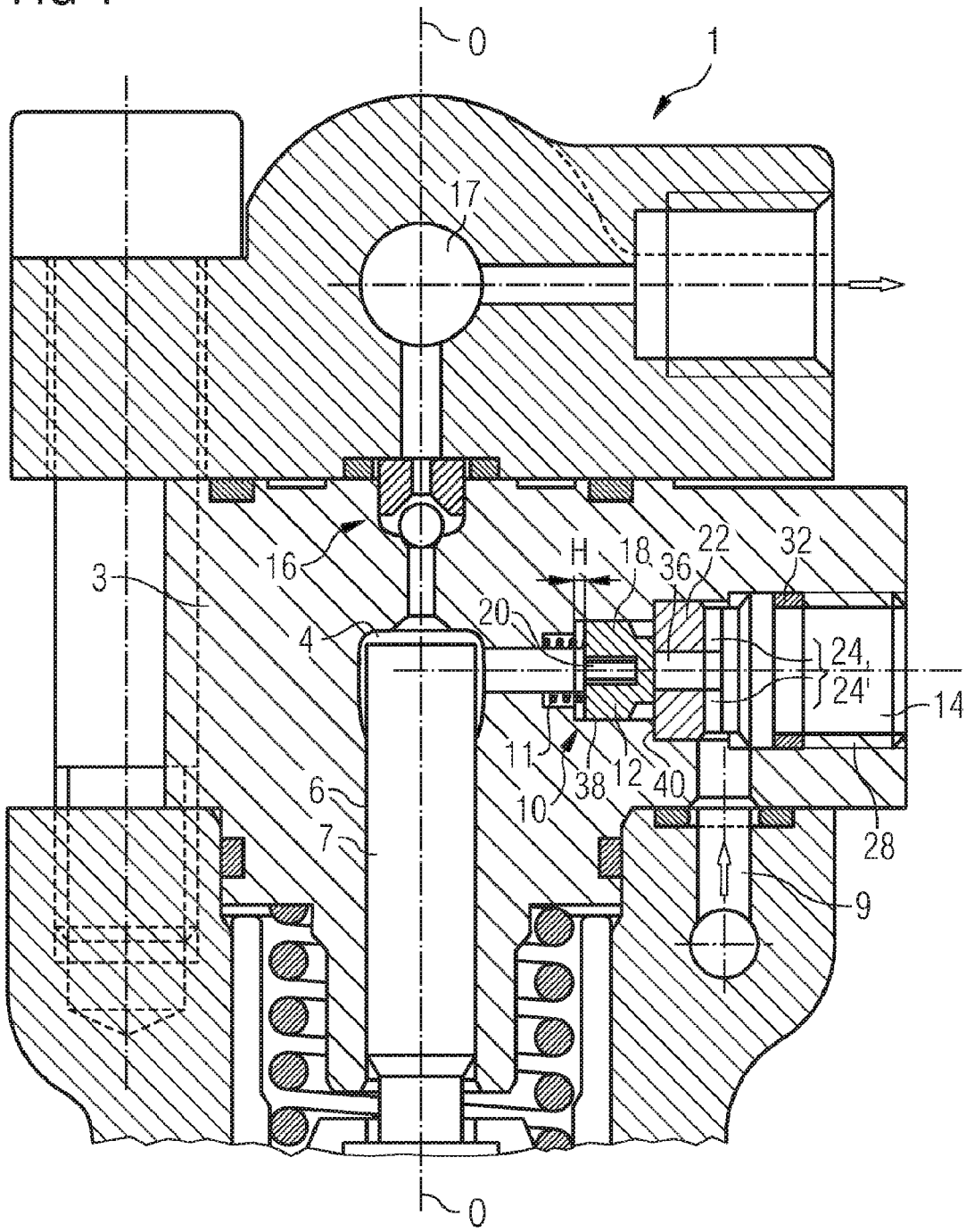
FIG. 1 a cross-section through a unit of a radial piston pump

FIG. 1 shows a radial piston pump 1 for supplying fuel at high pressure in an internal combustion engine. It is especially applicable to a common-rail injection system.

The radial piston pump 1 has a compression chamber 4 arranged in a displacement housing 3 as well as a reciprocating piston 7 arranged in a cylinder chamber 6. This piston 7 can for example be moved appropriately by an eccentric drive shaft known per se and not described in greater detail here.

Furthermore the radial piston pump 1 has a suction valve 10 which is connected to a fuel supply line 9. This suction valve 10 can be arranged in a direction transverse to the vertical axis O-O of the piston 7 in the displacement housing 3.

In this vertical axis O-O a pressure valve 16 which is connected to a fuel outlet line 17 is arranged above the piston 7, Fuel is supplied from the low pressure area via the suction valve 10 to the pump cylinder 7. After the pressure has built up the compressed fuel is drawn off via the pressure valve 16. This fuel flows into a high-pressure channel and via a high-pressure line to a fuel distributor, for example a common-rail system.

The suction valve 10 has a closure body 12 which is applied by a spring 11, in addition a stop plate 22 and a threaded pin 14 are provided.

Figure 2:
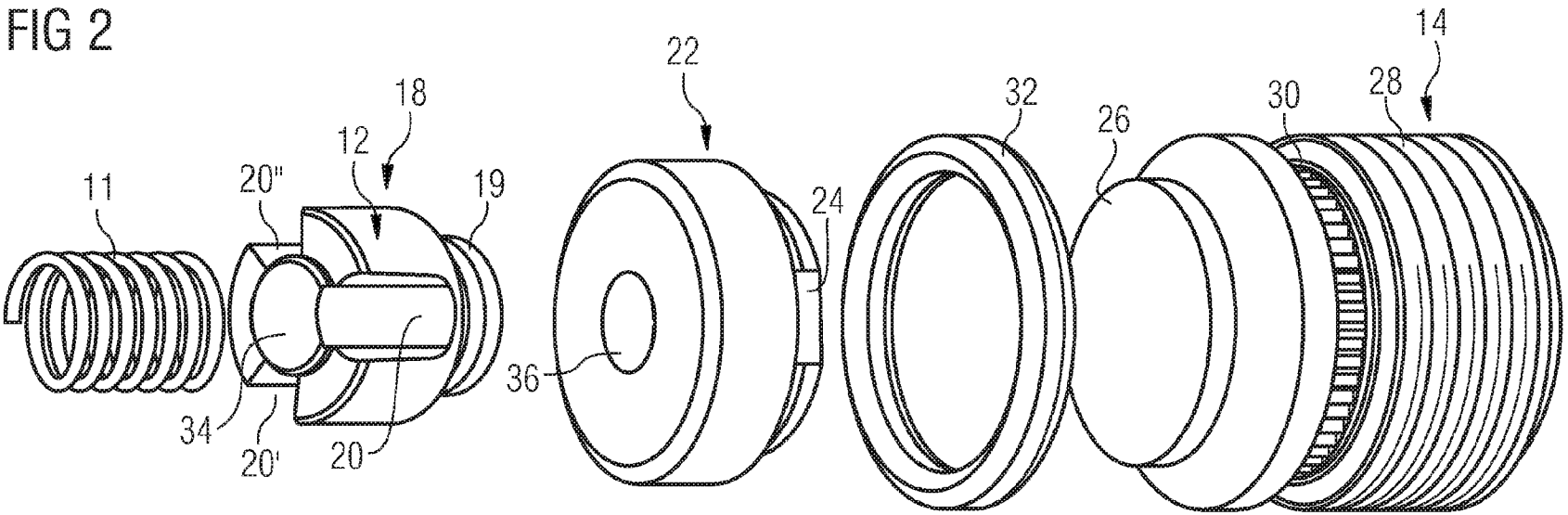
FIG. 2 an exploded view of the individual parts of the suction valve.

According to various embodiments, the closure body 12 of the suction valve 10 is embodied as a valve end pad 18 which, in accordance with FIG. 2 features a closure collar 19 and, connected thereto, three channels 20, 20', 20" distributed around its periphery. These channels pass through a base plate 34, which can be embodied as a support point for the spring 11.

The stop plate 22 adjoins the closure collar 19 of the valve end pad 18. This stop plate 22, on its side facing away from the closure collar 19, has at least two channels 24 and 24' running radially, connected to a through-opening 36, which lie in the area of the fuel supply line 9. The stop plate 22 is delimited on the back by the threaded pin 14, which in accordance with FIG. 1 possesses an area 28 for the threads.

As can be seen from FIG. 1, the valve end pad 18 rests displacably in a cylinder chamber 38 of the displacement housing 3 and, with its face side facing towards the spring 11 and the front side of the aforementioned cylinder chamber, defines the stroke H of the suction valve 10.

It can also be seen from FIG. 1 that the stop plate 22 is arranged between a collar 40 in the displacement housing 3 and the threaded pin 14 which is adjoined by the smaller-diameter cylinder chamber 38 for valve end pad 18.

It can be seen from FIGS. 1 and 2 that the threaded pin 14 adjacent to the area 28 of the thread has a circumferential groove 30, into which an annular seal 32 is inserted.

According to various embodiments, a vacuum is caused by the downwards movement of the piston 7 in the displacement chamber 4. This causes the suction valve 10 to open and the fuel can flow via the supply line 9, the base plate 36 and the channels 20, 20', 20" of the closure body 12 into the compression chamber 4.

The entire unit of the suction valve 10 is designed to be installation-friendly by virtue of its particular construction, with no setting of the stroke and the compression spring 11 being required. The clearance volume is optimized, which leads to a better pump efficiency, with the suction valve 10 overall being designed for streamlined flow with little constructional outlay.

What is claimed is:

1. A radial piston pump for supplying fuel at high pressure to an internal combustion engine, comprising a compression chamber arranged in a displacement housing, a reciprocating piston arranged in a cylinder chamber, a suction valve connected to a fuel supply line with a spring loaded closure body, an intermediate piece and a threaded pin and a pressure valve connected to a fuel outlet line, wherein the closure body of the suction valve is embodied as a valve end pad to the face side of which the spring is applied with a closure collar and adjoining said collar at least two channels distributed around its periphery and with an base plate and wherein a stop plate with an additional base plate borders the closure collar of the valve end pad as an intermediate piece, to which the threaded pin is connected.

2. The radial piston pump according to claim 1, wherein the valve end pad has three channels distributed around its periphery which pass through the base plate.

3. The radial piston pump according to claim 1, wherein the stop plate, on its side facing away from the closure collar has at least two channels running radially connected to the base plate which lie in the area of the fuel supply line.

4. The radial piston pump according to claim 1, wherein the suction valve is arranged in the transverse direction to a vertical axis of the piston.

5. The radial piston pump according to claim 1, wherein the suction valve is arranged in the displacement housing.

6. The radial piston pump according to claim 1, wherein the valve end pad is supported displaceably in a cylinder chamber of the displacement housing and defines with its front side facing towards the spring and the front side of the cylinder chamber the stroke of the suction valve.

7. The radial piston pump according to claim 1, wherein the threaded pin has a collar which with its face side adjoins the zone of the stop plate in which the base plate and the two channels are arranged.

8. The radial piston pump according to claim 1, wherein the threaded pin bordering the area of the threads has a groove around its circumference, into which an annular seal is inserted.

9. The radial piston pump according to claim 1, wherein the stop plate is arranged between a collar in the displacement housing and the threaded pin which is adjoined by the smaller-diameter cylinder chamber for the valve end pad.

10. A radial piston pump comprising:

a compression chamber arranged in a displacement housing, a reciprocating piston arranged in a cylinder chamber, a suction valve comprising a spring loaded valve end pad having a closure collar and adjoining said collar at least two channels distributed around its periphery and having a base plate, an intermediate piece, and a threaded pin and, wherein the suction valve is connected to a fuel supply line, a pressure valve connected to a fuel outlet line, and a stop plate with an additional base plate that borders the closure collar of the valve end pad as an intermediate piece, to which the threaded pin is connected.

11. The radial piston pump according to claim 10, wherein the valve end pad has three channels distributed around its periphery which pass through the base plate.

12. The radial piston pump according to claim 10, wherein the stop plate, on its side facing away from the closure collar has at least two channels running radially connected to the base plate which lie in the area of the fuel supply line.

13. The radial piston pump according to claim 10, wherein the suction valve is arranged in the transverse direction to a vertical axis of the piston.

14. The radial piston pump according to claim 10, wherein the suction valve is arranged in the displacement housing.

15. The radial piston pump according to claim 10, wherein the valve end pad is supported displaceably in a cylinder chamber of the displacement housing and defines with its front side facing towards the spring and the front side of the cylinder chamber the stroke of the suction valve.

16. The radial piston pump according to claim 10, wherein the threaded pin has a collar which with its face side adjoins the zone of the stop plate in which the base plate and the two channels are arranged.

17. The radial piston pump according to claim 10, wherein the threaded pin bordering the area of the threads has a groove around its circumference, into which an annular seal is inserted.

18. The radial piston pump according to claim 10, wherein the stop plate is arranged between a collar in the displacement housing and the threaded pin, which is adjoined by the smaller-diameter cylinder chamber for the valve end pad.

* * * * *